US007975372B2

(12) United States Patent
Carlotto

(10) Patent No.: US 7,975,372 B2
(45) Date of Patent: Jul. 12, 2011

(54) APPARATUS FOR PRODUCING ELECTRICAL WIRING

(75) Inventor: Vladimiro Carlotto, Zagarolo (IT)

(73) Assignee: K.M.I. Trade S.R.L., San Giorgio Delle Pertiche (IT)

( * ) Notice: Subject to any disclaimer, the term of this patent is extended or adjusted under 35 U.S.C. 154(b) by 0 days.

(21) Appl. No.: 11/543,043

(22) Filed: Oct. 5, 2006

(65) Prior Publication Data

US 2007/0082558 A1 Apr. 12, 2007

(30) Foreign Application Priority Data

Oct. 12, 2005 (IT) ..... PD2005A0297

(51) Int. Cl.
*H01R 43/00* (2006.01)

(52) U.S. Cl. ..... 29/749; 29/33 M

(58) Field of Classification Search ..... 29/748, 29/745, 749, 754, 755, 759, 33 F, 33 M, 868, 29/757, 837, 838, 709, 711, 712
See application file for complete search history.

(56) References Cited

U.S. PATENT DOCUMENTS 5,208,977 A * 5/1993 Ricard ..... 29/861
5,414,925 A * 5/1995 Nishide et al. ..... 29/748
5,509,195 A * 4/1996 Watanabe ..... 29/755
5,588,206 A * 12/1996 Maejima et al. ..... 29/845
5,943,751 A * 8/1999 Kamei ..... 29/33 M
5,964,392 A 10/1999 Long, Jr.
6,212,766 B1 * 4/2001 Ohsumi et al. ..... 29/755
2003/0045157 A1 * 3/2003 Suzuki ..... 439/404

FOREIGN PATENT DOCUMENTS

EP 0 365 137 A 4/1990
EP 0 661 781 A 7/1995
EP 1 043 813 A 10/2000

* cited by examiner

*Primary Examiner* — A. Dexter Tugbang
*Assistant Examiner* — Livius R Cazan
(74) *Attorney, Agent, or Firm* — Modiano & Associati; Albert Josif; Daniel O'Byrne

(57) ABSTRACT

An apparatus for producing electrical wiring constituted by at least one wire inserted in a corresponding receptacle of a connector provided with at least one corresponding electrical terminal, that comprises: a region for loading wires in corresponding preset seats, selected among a plurality of seats formed on a holder comb; a device for moving the holder comb from the loading region to a region for the insertion of the wires in preset receptacles of one or more preset connectors; a device for the guided translational motion of the ends of the wires within the preset receptacles of the preset connectors; and a programmable electronic device adapted to match, in the insertion region, a preset seat of the holder comb with a preset receptacle of a preset connector.

18 Claims, 8 Drawing Sheets

APPARATUS FOR PRODUCING ELECTRICAL WIRING

The present invention relates to an apparatus for producing electrical wiring of the type constituted by electrical wires inserted in corresponding receptacles of a connector provided with corresponding electrical terminals to which the wires are connected.

The apparatus also allows the possibility of complete wiring constituted by pairs of connectors interconnected by wires.

BACKGROUND OF THE INVENTION

Different apparatuses are currently available which are adapted to produce electrical wiring between wires and electrical terminals provided within connectors made of plastic material.

The various types of known apparatus include substantially "manual" apparatuses, semiautomatic apparatuses requiring a permanent operator, and apparatuses with a high level of automation.

Among the various "automations" provided, mention can be made of the automatic positioning in the connection region of the connector being processed, separated from a reel of connectors connected in series to each other, and of the positioning of individual wires in the connection region.

All these machines are often custom-designed for particular applications dedicated to specific connectors having given dimensions, and therefore have low flexibility in adapting to different connectors.

SUMMARY OF THE INVENTION

The aim of the present invention is to provide an apparatus for producing electrical wiring that is particularly fast and flexible in application to different connectors.

Within this aim, an object of the present invention is to provide an apparatus for producing electrical wiring that allows to increase the degree of automation with respect to similar apparatuses.

Another object of the present invention is to provide an apparatus for producing electrical wiring that is simple to use.

Another object of the present invention is to provide an apparatus for producing electrical wiring that can be manufactured with known components and technologies and with low costs.

This aim and these and other objects, which will become better apparent hereinafter, are achieved by an apparatus for producing electrical wiring, of the type constituted by at least one wire, at least one end of which is inserted in a corresponding receptacle of a connector provided with at least one corresponding electrical terminal, characterized in that it comprises:

- a region for loading at least one wire on a corresponding preset seat, selected among a plurality of seats formed on a holder comb;
- means for moving said holder comb from said loading region to a region for the insertion of at least one end of said at least one wire in a preset receptacle of a preset connector;
- means for the guided translational motion of said at least one end of said at least one wire within the preset receptacle formed in said preset connector;
- programmable electronic means adapted to match, in said insertion region, a preset seat of said holder comb with a preset receptacle of a said preset connector.

BRIEF DESCRIPTION OF THE DRAWINGS

Further characteristics and advantages of the invention will become better apparent from the following detailed description of two preferred but not exclusive embodiments thereof, illustrated by way of non-limiting example in the accompanying drawings, wherein.

DESCRIPTION OF THE PREFERRED EMBODIMENTS

Figure 1:
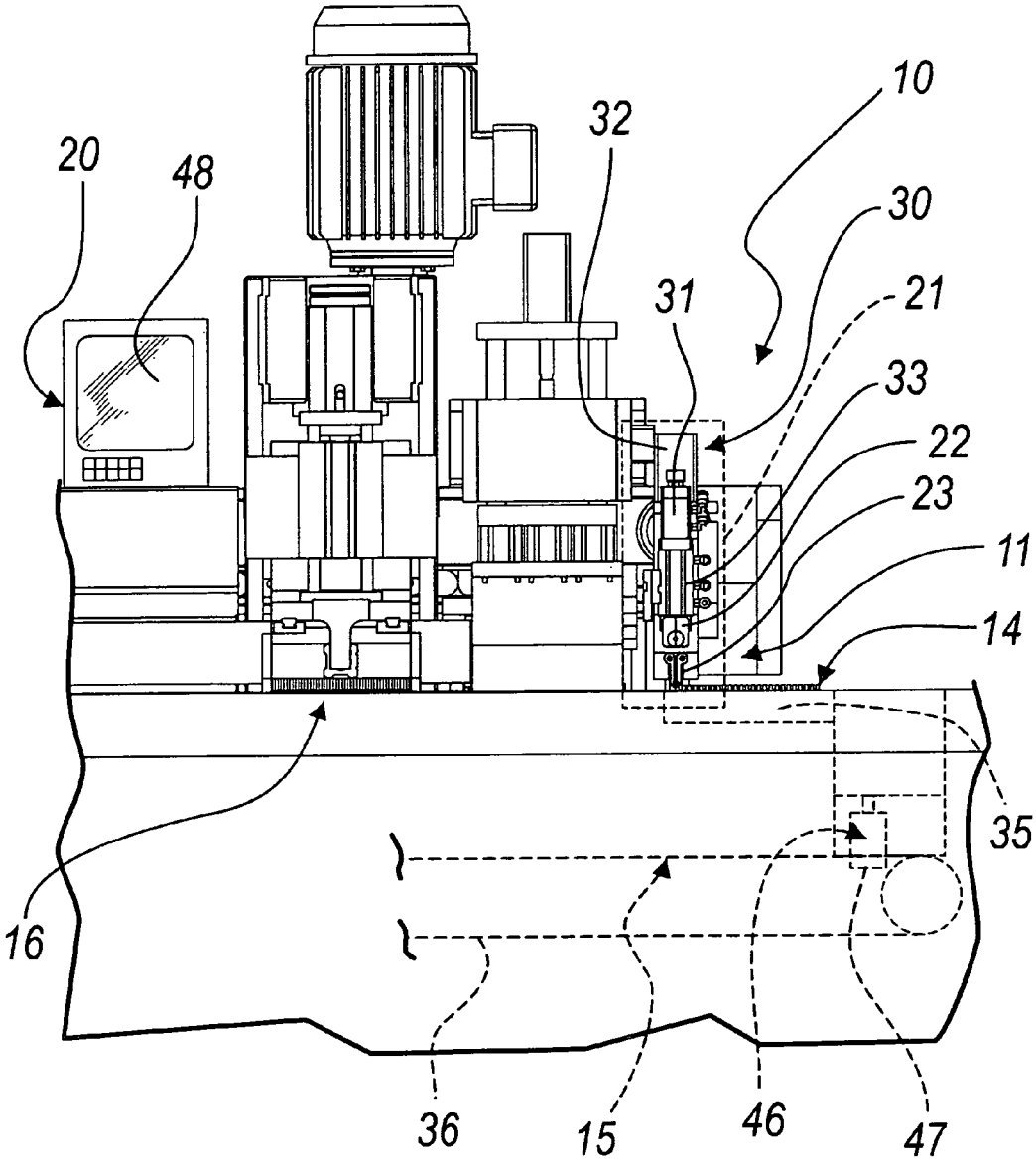
FIG. 1 is a schematic front view of a first apparatus according to the invention of the type with manual wire feeding.

It is noted that anything found to be already known during the patenting process is understood not to be claimed and to be the subject of a disclaimer.

With reference to the figures, an apparatus for producing electrical wiring, of the type constituted by at least one wire inserted in a corresponding receptacle of a connector provided with at least one corresponding electrical terminal, according to the invention, is generally designated by the reference numeral 10.

The apparatus 10 comprises a region 11 for loading wires 12 to be wired on corresponding preset seats 13 selected among a plurality of seats formed on a holder comb 14.

Movement means 15, described in greater detail hereinafter, are associated with the holder comb 14 for movement from the loading region 11 to a region 16 for the insertion of the wires 12 in preset receptacles 17 formed in one or more preset connectors 18 to be wired.

Figure 4A:
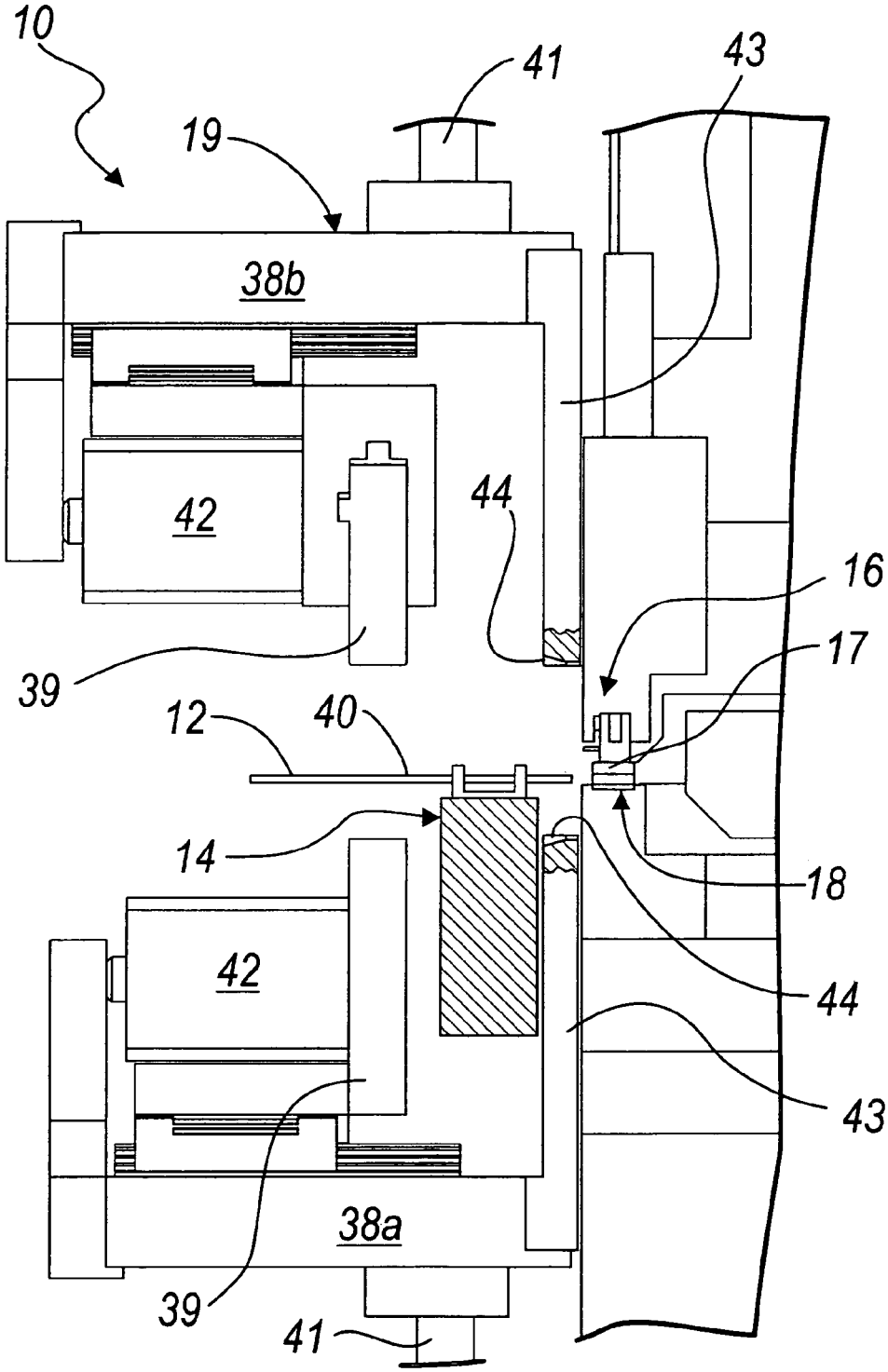
FIGS. 4*a* and 4*b* are respectively two schematic side views, taken at two different times, of the part of the apparatus according to the invention related to the insertion of the wires in the corresponding receptacles of corresponding connectors.
Figure 4B:
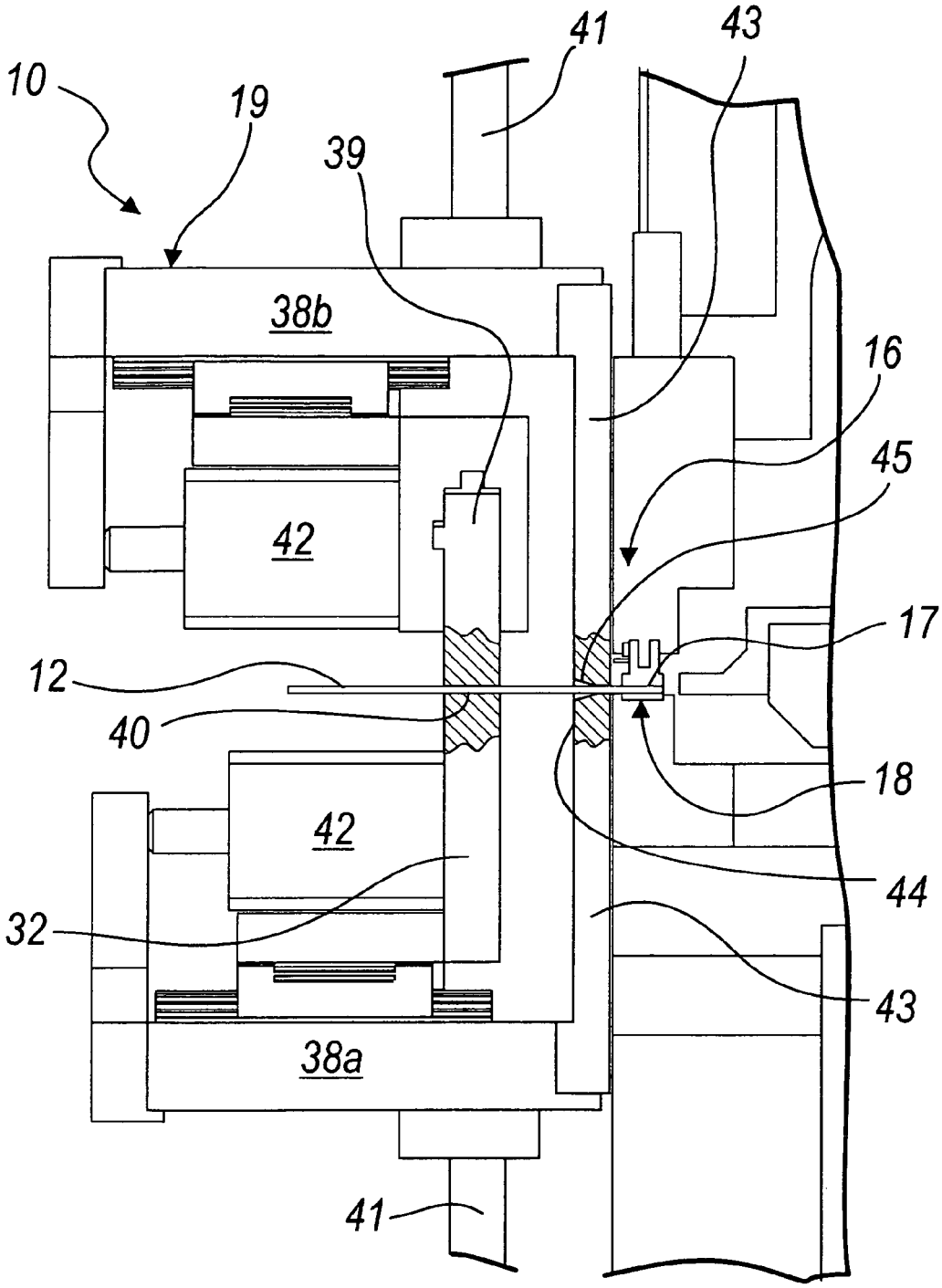
Figure 11:
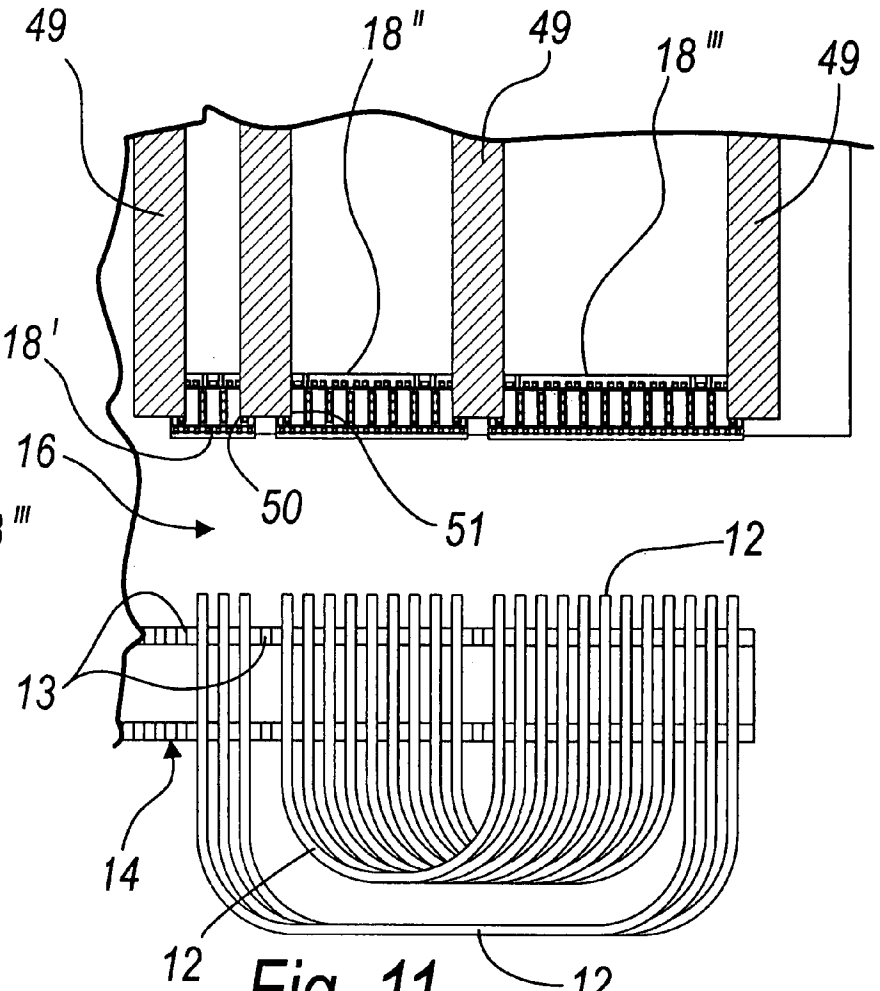
FIG. 11 is a schematic top view of the region for the insertion of wires in corresponding connectors of an apparatus according to the invention.

The connectors provided in the insertion region 16 can be one or more, depending on the type of wiring to be provided; FIGS. 4*a* and 4*b* are side views of the insertion region 16, and therefore a single connector 18 is shown, whereas FIG. 11 is a schematic top view of the insertion region 16, in which three connectors are shown, each having a different number of channels.

In this region 16 for the insertion of the wires 12 in the connector (or connectors) 18, guiding means 19, also described hereinafter, are provided for the guided translational motion of the ends of the wires 12 within the preset receptacles formed in the connector 18.

The apparatus 10 also comprises programmable electronic means 20, which are adapted to match, in the insertion region 16, the preset seats 13 of the holder comb 14, in which the corresponding wires 12 are provided, with the preset receptacles 17 of the connectors 18; these programmable electronic means 20 also will be described in greater detail hereinafter.

In particular, in the loading region 11 there is a grip and insertion assembly 21, which is adapted to grip a wire 12 and insert it in the preset seat 13 selected among the plurality of seats formed in the holder comb 14.

The grip and insertion assembly 21 is managed by the programmable means 20 in order to perform automated loading of the holder comb 14 according to a programmed sequence of preferred positions, which correspond to a matching number of preset receptacles 17 of the connector 18.

The grip and insertion assembly 21 comprises a first clamp 22 for centering the wire 12 and a second clamp 23 for locking and insertion in the preset programmed seat 13 formed in the holder comb 14.

Figure 2C:
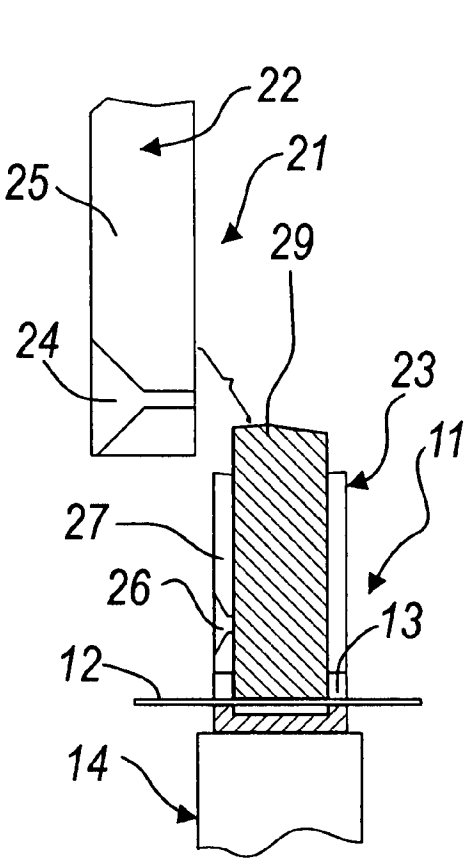
FIGS. 2*a*, 2*b* and 2*c* are respectively three schematic side views, taken at different times, of the part of the apparatus according to the invention related to the loading of said holder comb.
Figure 2B:
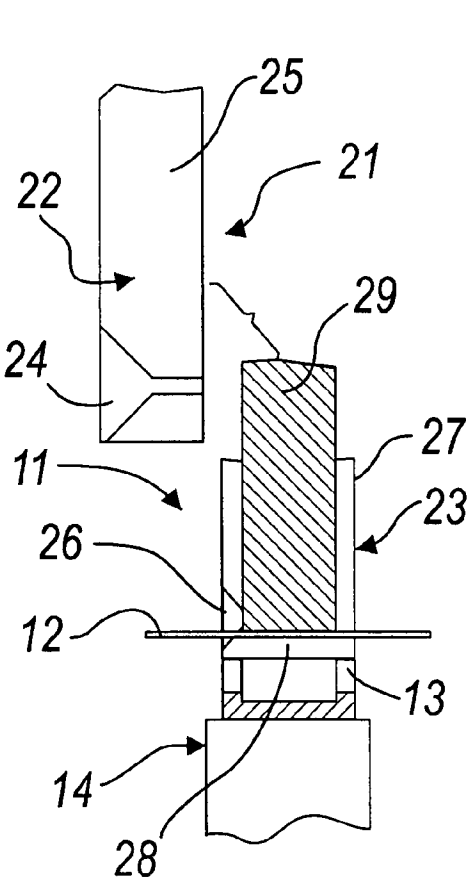
Figure 2A:
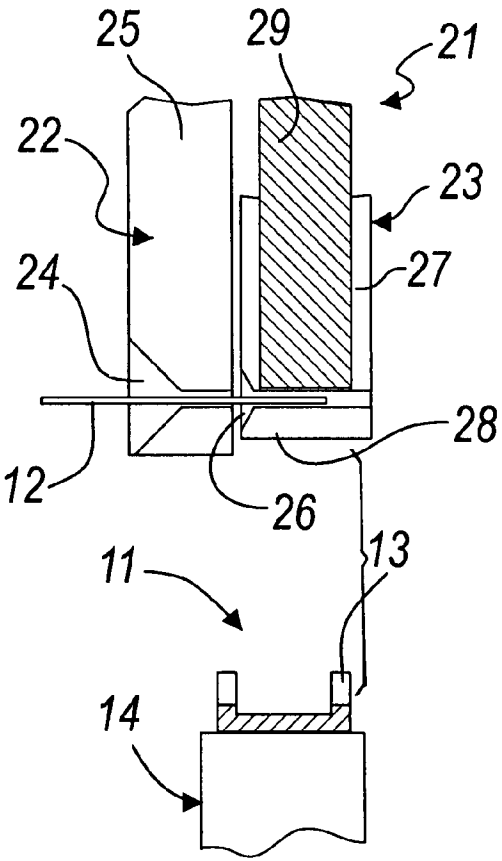
Figure 3:
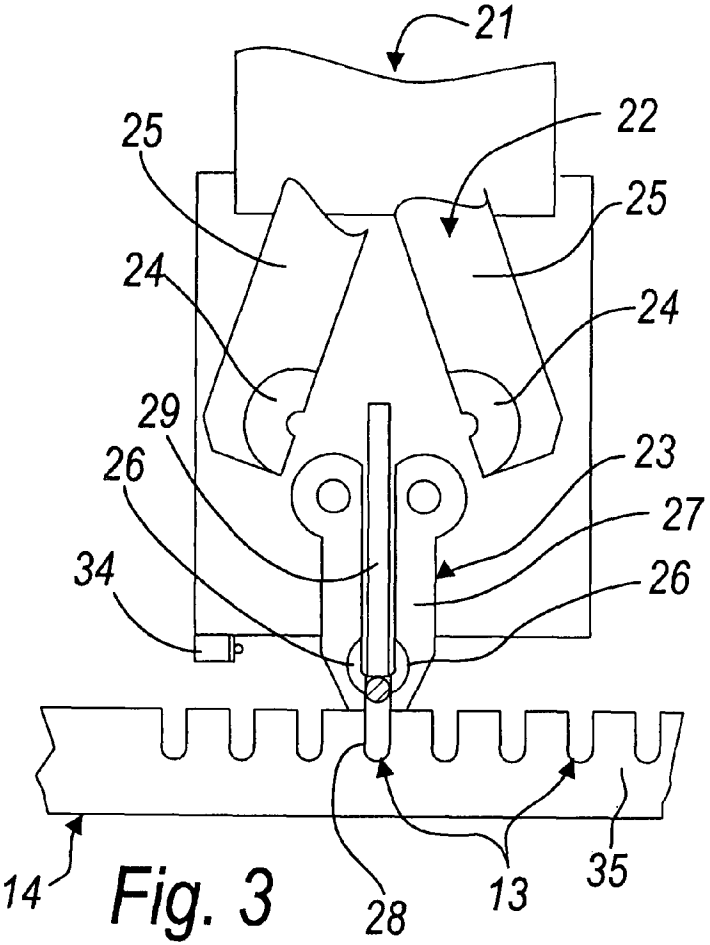
FIG. 3 is a schematic front view of the part of the apparatus according to the invention related to the loading of said holder comb at the same instant shown in FIG. 2*b;*

Said clamps are shown schematically in FIGS. 2 and 3.

The first clamp 22 comprises a first portion 24 for slidingly centering the wire 12, which is formed between corresponding first jaws 25; in particular, the first sliding centering portion 24 is constituted by two through frustum-shaped half-cavities, which face each other correspondingly.

The second clamp 23 comprises a second portion 26 for slidingly centering the wire 12, which is formed between corresponding second jaws 27, and a grip portion 28 for the wire 12.

The second sliding centering portion 26 is substantially coaxial to the corresponding first sliding centering portion 24 formed on the first clamp 22 during a step for receiving the wire 12 in the grip and insertion assembly 21.

A punch 29, for inserting the wire 12 from the grip portion 28 formed on the second clamp 23 in the preset seat 13 is associated with the second jaws 27.

To perform this insertion motion, the apparatus 10 is provided with means 30 for the translational motion of the second clamp 23 in the direction of the preset seat 13 (in this case, a vertical direction).

The translational motion means 30 (shown schematically in FIG. 1) comprise a first actuator 31 for translational motion, such as for example a pneumatic cylinder, which is rigidly coupled to the insertion punch 29 and is adapted to make it perform a short movement in order to move the wire 12 from a centering position to a grip position for the wire 12 on the second jaws 27 (between the portions 28), as shown in FIGS. 2*a* and 2*b*, a second translational motion actuator 32 (such as for example, likewise, a pneumatic cylinder), which is rigidly coupled to the clamp body of the first and second clamps and is adapted to move the wire 12 closer so as to lie above the preset seat 13 formed on the holder comb 14 (FIGS. 2*b* and 3), and a third translational motion actuator 33 (such as for example, likewise, a pneumatic cylinder), which is also rigidly coupled to the insertion punch 29 and is adapted to move the wire from the position that lies above the preset seat 13 into said seat (FIG. 2*c*).

The jaws of the first clamp 22 are opened by pneumatic means of a per se known type, not shown in the figures, while the jaws of the second clamp 23, in this embodiment, are kept closed by respective elastic elements which contrast their opening and are not shown in the figures; the opening of the jaws of the second clamp 23 is produced by the movement of the insertion punch 29, which during the descending motion pushes against inclined portions of said jaws, making them perform a controlled opening action.

The apparatus 10 comprises a sensor 34 for detecting the presence of the wire 12 within the second sliding wire centering portion 26 formed between the second jaws 27, constituted for example by a photocell which detects the presence or absence of the wire once it passes through the second sliding centering portion 26.

The sensor 34 is functionally associated with the first translational actuator 31 and is adapted to activate said actuator when it detects the presence of the wire 12.

The holder comb 14 is constituted by a frame 35 on which the seats 13 are formed according to a substantially horizontal orientation.

Each seat 13 is substantially U-shaped in order to accommodate from above the corresponding wire 12.

The means 15 for moving the holder comb 14 from the loading region 11 to the region 16 for the insertion of the wires 12 in the preset receptacles 17 of the preset connectors 18 are constituted by a horizontal translational actuator 36, which is functionally connected to the programmable electronic means 20, such as for example a horizontal conveyor belt, on which the holder comb 14 is mounted.

The horizontal translational actuator 36 further allows the vertical alignment of the corresponding preset seat 13 formed on the holder comb 14 with the direction of insertion of the corresponding wire 12 engaged on the grip and insertion assembly 21.

As regards the insertion region 16, the means 19 for the guided translational motion of the end of the wires 12 within the preset receptacles formed in the connectors 18 comprise two mutually opposite subframes 38, a first lower subframe 38*a* and a second upper subframe 38*b*, to which two corresponding mutually opposite pads 39 are rigidly coupled in order to lock a protruding portion 40 of the wires 12 when the holder comb 14 is positioned in the insertion region 11, as shown clearly in FIG. 4.

The two mutually opposite subframes 38 are associated with corresponding third translational actuators 41 of the vertical type, which are constituted for example by cylinders of the pneumatic type (only the end portions of the stems thereof are visible in FIGS. 4*a* and 4*b*).

Each mutually opposite pad 39 is rigidly coupled to the corresponding subframe 38 by way of the interposition of a corresponding fourth translational actuator 42 of the horizontal type, such as for example a pneumatic cylinder.

The means for guided translational motion 19 further comprise two mutually opposite vertical combs 43, each of which is rigidly coupled to a respective subframe 38 and therefore can perform a vertical translational motion, its free ends 44 being shaped so as to form, when they are in mutual contact, a guide 45 for feeding the wires 12 towards the preset receptacles 17 provided in the connector 18, said guide being formed for example by a through hole with a frustum-shaped inlet portion.

Means for vertical translational motion 46 are further associated with the holder comb 14 and are constituted by a fifth translational actuator 47 of the vertical type, which is interposed between the conveyor belt 36 and the frame 35 of the holder comb 14, such as for example a pneumatic cylinder, which as explained in greater detail hereinafter allows the extraction of the wires from the comb.

The programmable electronic means 20 are constituted by a PLC (Programmable Logic Controller), which is loaded on a computer 48 and is substantially interfaced with all the actuators, sensors and various actuation systems.

It should be noted that the holder comb 14 has a large number of seats 13 formed therein.

As mentioned, in the insertion region 16 there can be several connectors; FIG. 11 illustrates three connectors 18', 18", and 18''', which are arranged side by side and are provided with different numbers of channels.

It is important that every seat 13 of the comb be matched by a channel of one of the three connectors 18 and that each seat be aligned, during the step for the insertion of the ends of the wires in the connectors, with a corresponding channel; for this reason, replaceable spacers 49 are arranged between the connectors 18 and are designed for the particular type of connector used, such as to space adjacent connectors by an extent by virtue of which adjacent end channels 50 and 51 of two adjacent connectors are in practice spaced by the extent occupied by a hypothetical channel matched by a seat in the holder comb 14.

Examples of complete wiring are shown in FIGS. 7, 8, 9 and 10.

Figure 7:
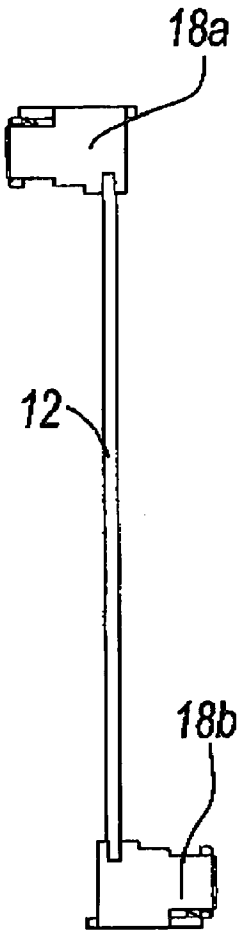
FIG. 7 is a side view of an arrangement of wires between two connectors, which can be provided with an apparatus according to the invention.

In particular, FIG. 7 is a side view of a wire 12 with the ends inserted in two respective connectors 18*a* and 18*b* oriented oppositely (by virtue of their particular wiring method).

Figure 8:
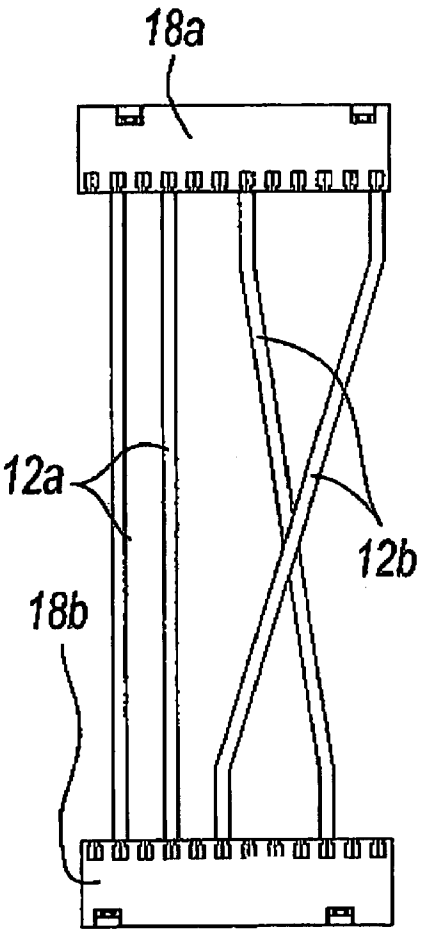
FIG. 8 is a top view of a first example of arrangement of wires between two connectors, which can be performed with an apparatus according to the invention.

FIG. 8 illustrates two connectors 18*a* and 18*b*, which are connected by two parallel wires 12*a* and two crossed wires 12*b*.

Figure 9:
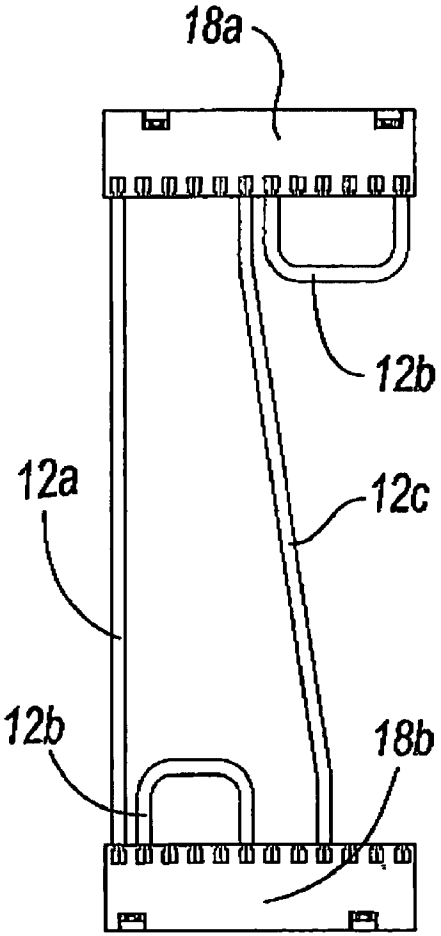
FIG. 9 is a top view of a second example of arrangement of wires between two connectors, which can be performed with an apparatus according to the invention.

FIG. 9 illustrates two connectors 18*a* and 18*b*, which are connected by a wire 12*a* which connects corresponding channels, two wires 12*b* the ends of which are inserted in the same connector, and a wire 12*c* which connects channels that do not match.

Figure 10:
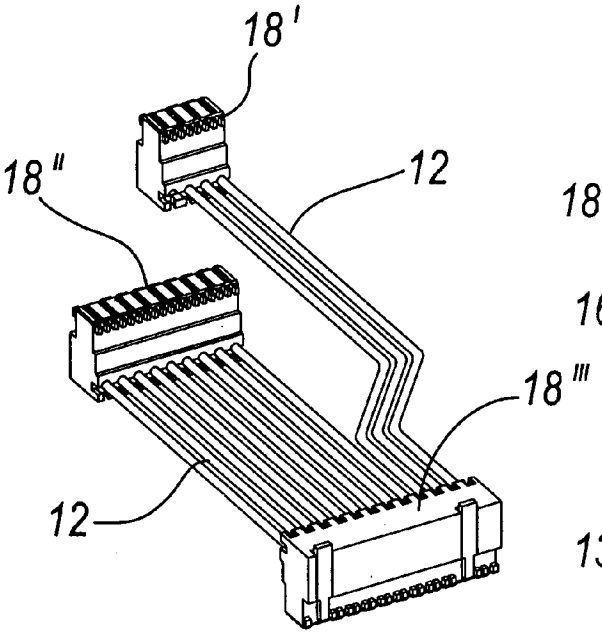
FIG. 10 is a perspective view of a third example of arrangement of wires between three connectors, which can be provided with an apparatus according to the invention.

FIG. 10 illustrates a wiring among three connectors 18', 18", and 18''', which correspond to the connectors of FIG. 11.

It is evident that it is possible to provide wirings even with a single connector, leaving the ends of the wires that have not been inserted loose for connection to another type of connection.

The operation of this first embodiment is as follows.

The holder comb 14 is arranged below the region occupied by the grip and insertion assembly 21.

Manually, or even automatically, a wire 12 is inserted through the first portion 24 for slidingly centering the wire 12 formed on the first clamp 22 and through the second portion 26 for slidingly centering the second clamp 23, which in this step are mutually coaxial.

By passing through the second sliding centering portion 26, the sensor 34 is activated and sends a signal to the PLC, which activates the first translational actuator 31, which makes the punch 29 perform a short movement in order to move the wire 12 from a centering position to a position for gripping the wire 12 between the portions 28 of the jaws of the second clamp 23; in this operation, the descent of the punch 29 opens the jaws of the second clamp 23 enough to grip the wire 12.

Then the PLC controls the second actuator 32 in order to make the clamp 23 (after opening the first jaws of the first clamp 22) perform a movement for the approach of the wire 12 so as to lie above the preset seat 13 formed in the holder comb 14.

Said holder comb has in fact been positioned correctly, by way of the movement of the horizontal translational actuator 36 (the conveyor belt), so as to match the direction of insertion of a wire 12 in a programmed seat 13 of the holder comb 14.

At this point, the PLC controls the third translational actuator 33 so as to produce the downward translational motion of the insertion punch 29 so as to move the wire 12 from the position that lies above the preset seat 13 therein.

The punch and the second clamp then rise to the position for accommodating a new wire, while the holder comb 14 is subjected to a translational motion so that a new programmed seat 13 matches up with the direction of insertion of the wire 12 from the second clamp 23.

At this point, in the case of a connection between two or more connectors (as in the case of FIGS. 7, 8, 9, 10 and 11) the insertion operation is repeated, with the free end of the wire that has just been handled, so as to make said wire assume a U-shaped configuration on the holder comb 14 (see FIG. 11).

When the holder comb 14 has been filled according to a programmed sequence, it is moved toward the insertion region 16, arranging it in front of the connector 18 so that each seat 13 in which an end of the wire 12 is present is aligned horizontally with a corresponding receptacle 17 of a preset connector 18 according to an order which is programmed by means of the PLC.

At this point, the two third translational actuators 41 are activated and produce a vertical translational motion of the two mutually opposite subframes 38 and consequently of the two mutually opposite pads 39, which block in a sandwich-like fashion the protruding portion 40 of the wires 12.

At the same time, the translational motion of the mutually opposite subframes 38 moves the free ends 44 of the mutually opposite vertical combs 43 into contact with each other, forming the guides 45 for guiding the wires 12 toward the preset receptacles 17.

The holder comb 14 is then lowered by actuating the fifth translational actuator 47, disengaging from said holder comb the wires 12 that are present in the corresponding seats 13.

Thus disengaged from the wires 12, the holder comb 14 is returned to the loading region 11 by means of the horizontal translational actuator 36, freeing the insertion region 16 from the space occupation of said holder comb, as shown in FIG. 4*b*.

The fourth translational actuators 42 are then actuated simultaneously and move the ends of the wires 12 inside the corresponding programmed receptacles 17 in the connector 18, where they are arranged in electrical contact with the terminals (not shown in the figures).

For example, the crimping of the wires to the corresponding terminals provided in the connectors 18 occurs by pressing at right angles to the wires the covers (not shown in the figures) of the connectors that are placed on said connectors, in a per se known manner; in practice, each cover, by mating stably with its connector, pushes the ends of the wires toward the crimping region of the corresponding terminals, where there are laminas which, by interference, strip the external sheath of the wire, thus coming into electrical contact with the copper of said wire.

It is evident that the method of connection of the wire to the terminal can be of any type and so can be the method for positioning the connector 18 in the insertion region 16.

Once the ends of the wires have been inserted in the channels of the connectors, said connectors, together with the wires, are moved to a pickup region (not shown in the figures).

Before this step, the correct insertion of the ends of the wires in the channels of the connectors is checked by way of sensor means not shown in the figures.

Said sensor means can be constituted for example by small pins which are aligned to the rear of the channels of the connectors and are centered on said channels so as to touch the ends of the inserted wires; the trailing ends of said pins are arranged so as to block the field of an optical sensor when the ends of the wires are inserted correctly in the channels, and clear the viewing field of the sensor when the ends of the wires are not inserted correctly.

Figure 6:
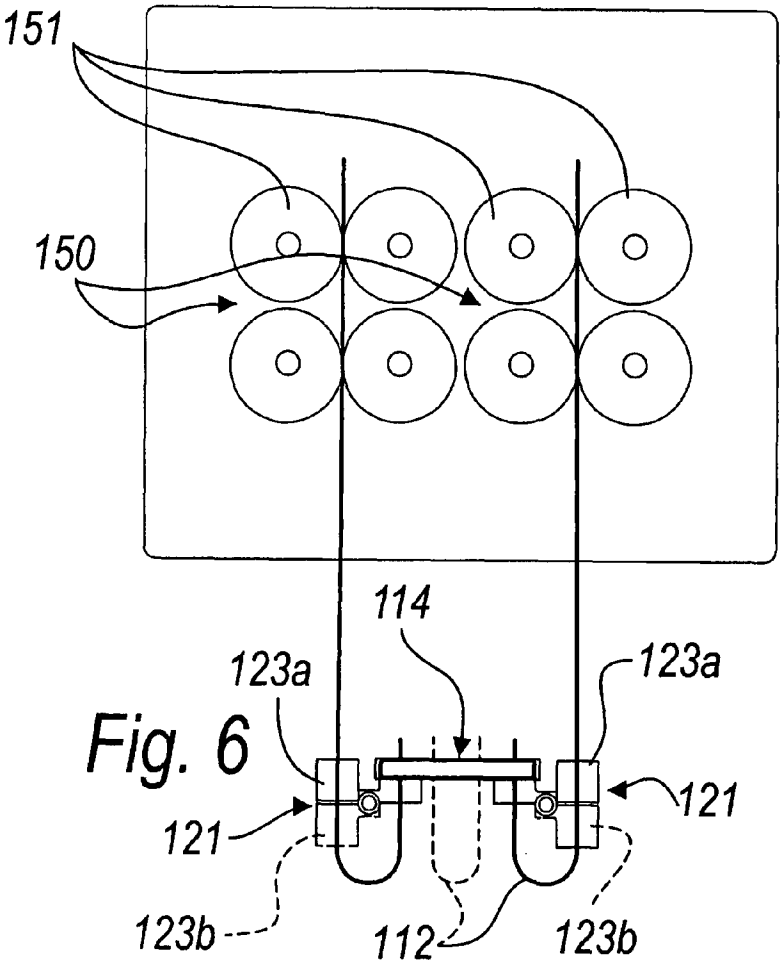
FIG. 6 is a schematic top view of the part of the apparatus of FIG. 5 related to the loading of said holder comb.
Figure 5:
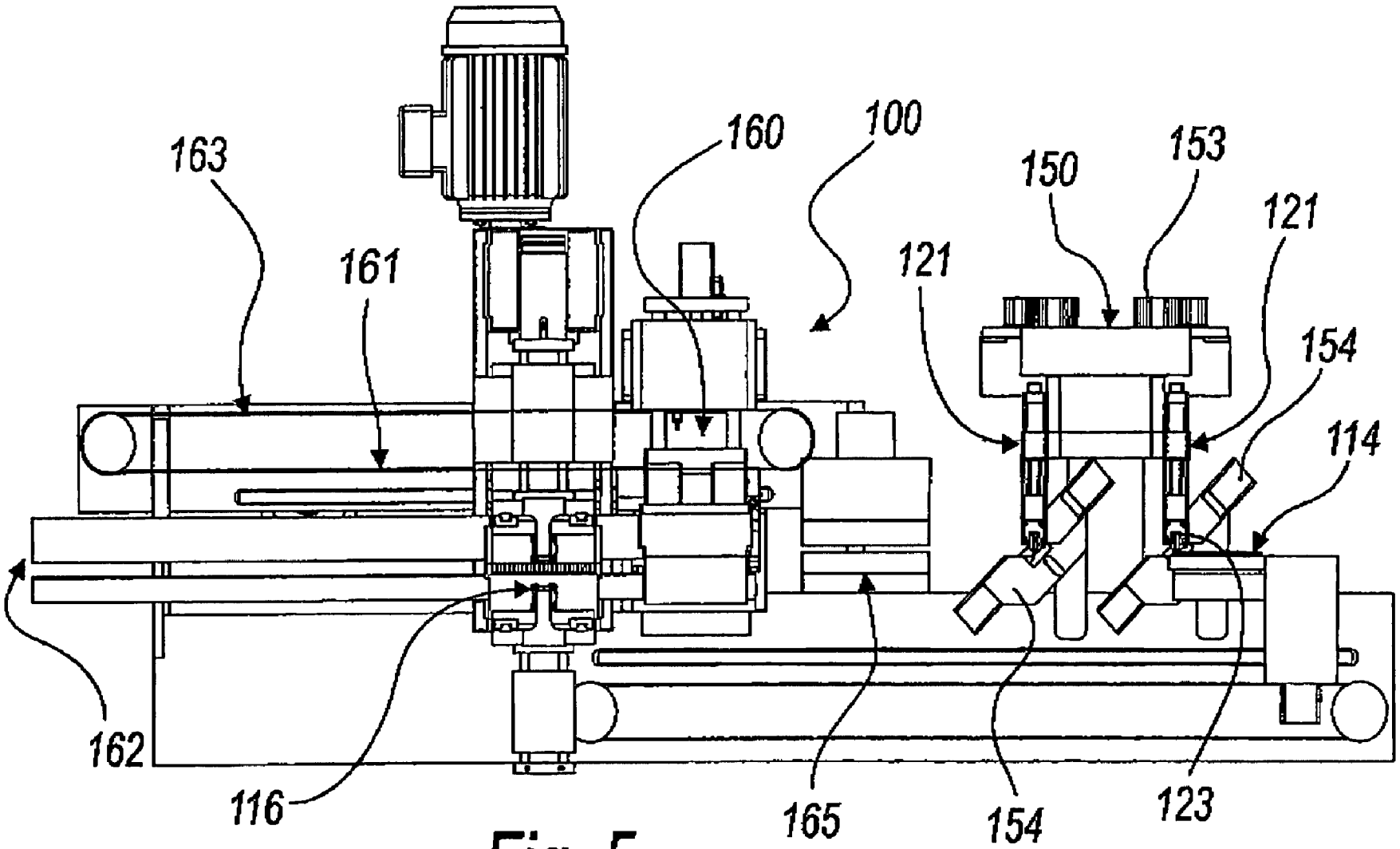
FIG. 5 is a schematic front view of an alternative embodiment of an apparatus according to the invention, of the type with automatic wire feeding.

FIGS. 5 and 6 illustrate an alternative embodiment of the apparatus according to the invention, which illustrates an automatic method for associating the wire with the assembly for grip and insertion in the holder comb.

In particular, said apparatus, now designated by the reference numeral 100, has two grip and insertion assemblies 121 arranged parallel to each other.

Each grip and insertion assembly 121 has an automatic wire feeder 150, which is shown schematically in FIG. 6 by means of two mutually opposite pairs of wheels 151, which move said wire from a storage unit toward the assembly 121.

Each grip and insertion assembly 121, in this embodiment, comprises two second clamps for locking and inserting the wire in the holder comb 114, respectively a second fixed clamp 123*a* and a second rotating clamp 123*b*.

Said second clamps are substantially similar to the ones of the embodiment described earlier and differ only in that they do not have an associated translational actuator for their vertical movement, since they are already arranged at the correct height for insertion, on the part of the insertion punch (not shown in FIGS. 5 and 6, since it is similar to the one already described), of the wire 112 in the holder comb 114.

The second rotating clamp 123*b* is pivoted to the structure of the apparatus about a vertical axis and is associated with rotation means 153, such as for example an electric motor drive, which is adapted to allow its rotation through 180°, as shown in broken lines in FIG. 6.

In particular, said second rotating clamp 123*b* has two positions: a first position (shown in broken lines in FIG. 6), in which the portion for centering the wire 112 of the corresponding jaws is substantially coaxial to the centering portion of the jaws of the second fixed clamp 123*a*, and a second position, which is rotated through 180° so as to be aligned laterally with the second fixed clamp 123*a*.

The wire, by means of the automatic wire feeder 150, is inserted in the coaxially centered centering portions of the second clamps 123*a* and 123*b*.

At this point, the second rotating clamp 123*b* rotates through 180°, moving above a preset seat of the holder comb 114, while the automatic wire feeder 150 continues to feed the wire 112 up to a preset measurement; the wire assumes a U-shaped configuration.

The second rotating clamp 123*b* is actuated, and one end of the wire 112 is inserted in the preset seat of the holder comb 114.

At this point, by way of cutting means 154, the wire 112 is cut ahead of the second fixed clamp 123*a*, thus obtaining a U-shaped portion of wire.

The second fixed clamp 123*a* is actuated and the new end of the portion of wire 112 is inserted in another preset seat of the holder comb 114.

By means of similar methods, the insertion of new wires and/or portions of wires is continued so as to provide the intended combination of crossings; the presence of two assemblies 121 allows to provide faster loading, since while one assembly is loading one wire, the other assembly prepares the next one.

Once the holder comb 114 has been loaded, it moves toward additional cutting means 165, by means of which the ends of the wires are all trimmed at the same distance from the holder comb, so as to have all identical lengths of insertion in the connectors.

Once the wires have been trimmed, the holder comb is moved toward the insertion region 116 and the same steps described earlier follow.

In the insertion region there can be two or more connectors, as already illustrated in the preceding example, which are mutually spaced conveniently by means of spacers similar to the ones that have already been described.

The insertion of the ends of the wires in the connectors occurs substantially in the same manner as in the previously described example.

As regards the connectors, they are taken from a separation region 160 and moved to the insertion region 116, to the region 161 for checking the correct insertion of the wires in said connectors and to the region for unloading the finished wired connectors 162 by means of an electronic translational unit 163.

This method of transfer of the connectors is substantially the same as in the first embodiment, although it has not been described.

In practice it has been found that the invention as described achieves the intended aim and objects; in particular, the present invention provides an apparatus for providing electrical wiring that is particularly flexible in application to mutually different connectors.

In fact, the use of a holder comb that has a large number of seats for accommodating wires 12 and the possibility to load it automatically and in a programmed manner according to such an order that each seat occupied by a wire is matched by a prearranged receptacle of the connector 13 causes the wiring to occur rapidly and in a highly automated manner and to be applicable to connectors that have a different number of receptacles for said wires.

Further, the apparatus according to the invention allows to produce in a completely automated manner complete wirings of connectors according to the chosen combinations of wires and channels, something which known apparatuses allow only by using extremely complicated and bulky modules.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2005A000297 from which this application claims priority are incorporated herein by reference.

What is claimed is:

1. An apparatus for producing electrical wiring constituted by at least one wire (12), at least one end of which is inserted in a corresponding receptacle (17) of a connector (18) provided with at least one corresponding electrical terminal, the apparatus having a body structure on which are provide:

a holder comb (14) constituted by a frame (35) and comprising a plurality of seats (13) formed thereon in a substantially horizontal arrangement, each of said seats (13) being substantially U-shaped in order to accommodate from above a corresponding wire (12);

a loading region (11) for loading at least one wire (12) on a corresponding preset seat (13), selected among said plurality of seats (13) formed on said holder comb (14) arranged in said loading region (11);

movement means (15) for moving said holder comb (14) with said at least one wire (12) loaded on said corresponding preset seat (13) from said loading region (11) to a region (16) for insertion of at least one end of said at least one wire (12) in a preset receptacle (17) of a preset connector (18);

guiding means (19) for guided translational motion of said at least one end of said at least one wire (12) within the preset receptacle (17) formed in the preset connector (18);

programmable electronic means (20) adapted to match, in said insertion region (16), a preset seat (13) of said holder comb (14) with a preset receptacle (17) of the preset connector (18); and at least one grip and insertion assembly (21) provided in said loading region (11) for inserting a corresponding wire (12) within the preset seat (13) selected among the plurality of seats (13) formed on said holder comb (14), said at least one grip and insertion assembly (21) being managed by said programmable electronic means (20) to perform an automated loading of said holder comb, (14) according to a programmed sequence of preferred positions, which correspond to a matching number of the preset receptacles (17) of one or more connectors (18) provided in said insertion region (16); and wherein said guiding means (19) comprise two mutually opposite subframes (38*a*, 38*b*), a first lower subframe (38*a*) and a second upper subframe (38*b*), with two corresponding mutually opposite pads (39) rigidly coupled to said first and second subframes (38*a*, 38*b*) in order to lock a protruding portion (40) of the at least one wire (12) when said holder comb (14) is arranged in said insertion region (16), said two mutually opposite subframes (38*a*, 38*b*) comprising associated corresponding translational actuators (41) of a vertical type, and translational actuators (42) of a horizontal type, each of said mutually opposite pads (39) being rigidly coupled to a corresponding one of said subframes (38*a*, 38*b*) by interposition of a corresponding one of said translational actuators (42) of a horizontal type, said guiding means (19) further comprising two mutually opposite vertical combs (43), each of which is rigidly coupled to a respective one of said subframes (38*a*, 38*b*) and is adapted to perform a vertical translational motion, free ends (44) thereof forming, when in mutual contact, a guide (45) for inserting the at least one end of the at least one wire (12) toward the preset receptacle (17) provided in the connector (18), said holder comb (14) being further provided with comb vertical translational motion means (46) for vertical translational motion thereof.

2. The apparatus of claim 1, wherein said at least one grip and insertion assembly (21) comprises a first clamp (22) for centering the wire (12) and a second clamp (23) for locking and insertion in said preset seat (13) formed in said holder comb (14), said second clamp (23) comprising translational motion means (30) for translational motion thereof in a direction of said preset seat (13) formed on said holder comb (14).

3. The apparatus of claim 2, wherein said first clamp (22) comprises a first centering portion (24) for slidingly centering the wire (12), which is formed between corresponding first jaws (25) thereof, said second clamp (23) comprising a second centering portion (26) for slidingly centering the wire (12), which is formed between corresponding second jaws (27) thereof and a grip portion (28) for said wire (12), said second centering portion (26) being substantially coaxial to said first centering portion (24) during a step for accommodating said wire (12) in said at least one grip and insertion assembly (21), and wherein the apparatus further comprises an insertion punch (29) associated with said second jaws (27) for insertion of the wire (12) from said grip portion (28) formed on said second clamp (23) into said preset seat (13).

4. The apparatus of claim 3, wherein said translational motion means (30) comprise:

a first translational clamp actuator (31), which is adapted to make said insertion punch (29) perform a short movement in order to move the wire (12) from a centering position to a position for gripping the wire (12) on said second jaws (27), a second translational clamp actuator (32), rigidly coupled to the clamp body of the first and second clamps (22, 23), which is adapted to make the wire (12) perform an approaching movement so as to lie above said preset seat (13) formed on said holder comb (14), a third translational clamp actuator (33), which is rigidly coupled to said insertion punch (29) and is adapted to move the wire (12) from the position above said preset seat (13) into said seat (13).

5. The apparatus of claim 4, comprising a presence sensor (34) for detecting presence of the wire (12) within said second centering portion (26) for slidingly centering the wire (12) which is formed between corresponding said second jaws (27), said presence sensor (34) being functionally associated with said first translational clamp actuator (31) and being adapted to actuate said first translational clamp actuator (31) upon detection of the presence of the wire (12).

6. The apparatus of claim 3, wherein said at least one grip and insertion assembly is constituted by two grip and insertion assemblies (121) that comprise each two second clamps for locking and insertion of the wire (112) in the holder comb (114), respectively a second fixed clamp (123*a*) and a second rotating clamp (123*b*), both of which are arranged at a correct height for insertion, on a part of the insertion punch (29), of the wire (112) in said holder comb (114), said second rotating clamp (123*b*) being pivoted to the structure of the apparatus (100) about a vertical axis and being provided with rotation means (153) adapted to allow rotation thereof through 180°, said second rotating clamp (123*b*) being rotatable in two positions, a first position in which a corresponding one of said jaws has a portion thereof for centering the wire (112) arranged substantially coaxially to a centering portion of jaws of said second fixed clamp (123*a*), and a second position, which is rotated through 180° so as to be aligned laterally with respect to said second fixed clamp (123*a*).

7. The apparatus of claim 6, comprising the two grip and insertion assemblies (121) arranged parallel to each other, each grip and insertion assembly (121) having an automatic wire feeder (150).

8. The apparatus of claim 6, comprising cutting means (154) for cutting the wire (112) once the wire has been fed to said second fixed and rotating clamps (123*a*, 123*b*) and additional cutting means (165) for trimming ends of the at least one U-shaped portion of wire (112), loaded on said holder comb (14), to be inserted in said at least one connector (18).

9. The apparatus of claim 6, comprising an electronic translational unit (163) for taking of connectors from a separation region (160) and movement thereof, respectively into the insertion region (116), into a region (161) for checking a correct insertion of the wires (112) in the connectors (162), and into a region for unloading the finished wired connectors (162).

10. The apparatus of claim 1, comprising a horizontal translational actuator (36) connected with said holder comb (14), that is functionally connected to said programmable electronic means (20), and is adapted to allow a vertical alignment of the corresponding preset seat (13) formed in said holder comb (14) with a direction of insertion of the end of a corresponding wire (12) engaged on said at least one grip and insertion assembly (21).

11. The apparatus of claim 10, wherein said movement means (15) are constituted by said horizontal translational actuator (36).

12. The apparatus of claim 11, wherein said horizontal translational actuator (36) is constituted by a horizontally-arranged conveyor belt on which said holder comb (14) is mounted.

13. The apparatus of claim 12, wherein said vertical translational motion means (46) comprise a translational actuator (47) of a vertical type, which is interposed between said conveyor belt and said holder comb (14).

14. The apparatus of claim 1, comprising spacers (49) located in said insertion region (16) adapted to space adjacent connectors (18) by such an extent that adjacent terminal channels (50, 51) of said adjacent connectors (18) are spaced by the extent occupied by an imaginary channel matched by one of said seats (13) in said holder comb (14).

15. An apparatus for producing electrical wiring constituted by wires (12), at least one end of which is inserted in corresponding receptacles (17) of a connector (18) provided with at least one corresponding electrical terminal, the apparatus having a body structure on which are provided;

a holder comb (14) constituted by a frame (35) and comprising a plurality of seats (13) formed thereon in a substantially horizontal arrangement, each of said seats (13) being substantially U-shaped in order to accommodate from above a corresponding wire (12);

a loading region (11) for loading wires (12) on corresponding preset seats, selected among said plurality of seats (13) formed on said holder comb (14) arranged in said loading region (11);

movement means (15) for moving said holder comb (14) with said wires (12) loaded on said corresponding preset seats (13) from said loading region to a region (16) for insertion of at least one end of said wires (12) in preset receptacles (17) of a preset connector (18);

guiding means (19) for guided translational motion of said at least one end of said wires (12) within the preset receptacles (17) formed in the preset connector (18), said guiding means (19) comprising two mutually opposite subframes (38a, 38*b*), a first lower subframe (38*a*) and a second upper subframe (38*b*), with two corresponding mutually opposite pads (39) rigidly coupled to said first and second subframes (38*a*, 38*b*) in order to lock a protruding portion (40) of the wires (12) loaded on said corresponding preset seats (13) when said holder comb (14) is arranged in said insertion region (16), said two mutually opposite subframes (38*a*, 38*b*) comprising associated corresponding translational actuators (41) of a vertical type and translational actuators (42) of a horizontal type, each of said mutually opposite pads (39) being rigidly coupled to a corresponding one of said subframes (38*a*, 38*b*) by interposition of a corresponding one of said translational actuators (42) of a horizontal type, and mutually opposite vertical combs (43), each of which is adapted to perform a vertical translational motion, free ends (44) thereof forming, when in mutual contact, respective guides (45) for inserting the at least one end of the wires (12) simultaneously toward the preset receptacles (17) provided in the connector (18);

programmable electronic means (20) adapted to match, in said insertion region (16), a preset seat (13) of said holder comb (14) with the preset receptacle (17) of the preset connector (18); and at least one grip and insertion assembly (21) provided in said loading region (11) for inserting a corresponding wire (12) within the preset seat (13) selected among the plurality of seats (13) formed on said holder comb (14), said at least one grip and insertion assembly (21) being managed by said programmable electronic means (20) to perform an automated loading of said holder comb (14) according to a programmed sequence of preferred positions, which correspond to a matching number of the preset receptacles (17) of one or more connectors (18) provided in said insertion region (16).

16. An apparatus for producing electrical wiring constituted by at least one wire (12), at least one end of which is inserted in a corresponding receptacle (17) of a connector (18) provided with at least one corresponding electrical terminal, the apparatus having a body structure on which are provided:

a holder comb (14);

a region (11) for loading at least one wire (12) on a corresponding preset seat (13), selected among a plurality of seats (13) formed on said holder comb (14);

movement means (15) for moving said holder comb (14) from said loading region (11) to a region (16) for insertion of at least one end of said at least one wire (12) in a preset receptacle (17) of a preset connector (18);

guiding means (19) for guided translational motion of said at least one end of said at least one wire (12) within the preset receptacle (17) formed in the preset connector (18);

programmable electronic means (20) adapted to match, in said insertion region (16), a preset seat (13) of said holder comb (14) with a preset receptacle (17) of the preset connector (18);

at least one grip and insertion assembly (21) provided in said loading region (11) for inserting a corresponding wire (12) within the preset seat (13) selected among a plurality of seats (13) formed on said holder comb (14), said at least one grip and insertion assembly (21) being managed by said programmable electronic means (20) to perform an automated loading of said holder comb (14) according to a programmed sequence of prefezred positions, which correspond to a matching number of the preset receptacles (17) of one or more connectors (18) provided in said insertion region (16), and wherein said at least one grip and insertion assembly (21) comprises a first clamp (22) for centering the wire (12) and a second clamp (23) for locking and insertion in said preset seat (13) formed in said holder comb (14), said second clamp (23) comprising translational motion means (30) for translational motion thereof in a direction of said preset seat (13) formed on said holder comb (14), and wherein said first clamp (22) comprises a first centering portion (24) for slidingly centering the wire(12), which is formed between corresponding first jaws (25) thereof, said second clamp (23) comprising a second centering portion (26) for slidingly centering the wire (12), which is formed between corresponding second jaws (27) thereof and a grip portion (28) for said wire (12), said second centering portion (26) being substantially coaxial to said first centering portion (24) during a step for accommodating said wire (12) in said at least one grip and insertion assembly (21), and wherein the apparatus (10) further comprises an insertion punch (29)

associated with said second jaws (27) for insertion of the wire (12) from said grip portion (28) formed on said second clamp (23) into said preset seat (13), and wherein said translational motion means (30) for translational motion of the second clamp (23) in a direction of said preset seat (13) comprise:

a first translational clamp actuator (31), which is adapted to make said insertion punch (29) perform a short movement in order to move the wire (12) from a centering position to a position for gripping the wire (12) on said second jaws (27), a second translational clamp actuator (32), rigidly coupled to the clamp body of the first and second clamps (22, 23), which is adapted to make the wire (12) perform an approaching movement so as to lie above said preset seat (13) formed on said holder comb (14), and a third translational clamp actuator (33), which is rigidly coupled to said insertion punch (29) and is adapted to move the wire (12) from the position above said preset seat (13) into said seat (13).

17. The apparatus of claim 16, wherein said holder comb (14) is constituted by a frame (35) on which said seats (13) are formed in a substantially horizontal arrangement, each of said seats (13) being substantially U-shaped in order to accommodate from above a corresponding wire (12).

18. The apparatus of claim 16, wherein said guiding means comprise two mutually opposite subframes (38*a*, 38*b*), a first lower subframe (38*a*) and a second upper subframe (38*b*), with two corresponding mutually opposite pads (39) rigidly coupled to said first and second subframes (38*a*, 38*b*) in order to lock a protruding portion (40) of the at least one wire (12) when said holder comb (14) is arranged in said insertion region (16), said two mutually opposite subframes (38*a*, 38*b*) comprising associated corresponding translational actuators (41) of a vertical type, and translational actuators (42) of a horizontal type, each of said mutually opposite pads (39) being rigidly coupled to a corresponding one of said subframes (38*a*, 38*b*) by interposition of a corresponding one of said translational actuators (42) of a horizontal type, said guiding means (19) further comprising two mutually opposite vertical combs (43), each of which is rigidly coupled to a respective one of said subframes (38*a*, 38*b*) and is adapted to perform a vertical translational motion, free ends (44) thereof forming, when in mutual contact, a guide (45) for inserting the at least one end of the at least one wire (12) toward the preset receptacle (17) provided in the connector (18), said holder comb (14) being further provided with vertical translational motion means (46) for vertical translational motion thereof.

* * * * *